US010837409B2

(12) United States Patent
Kugo et al.

(10) Patent No.: US 10,837,409 B2
(45) Date of Patent: Nov. 17, 2020

(54) PURGE SYSTEM MALFUNCTION DIAGNOSIS DEVICE

(71) Applicant: SUBARU CORPORATION, Tokyo (JP)

(72) Inventors: Daisuke Kugo, Tokyo (JP); Masahiro Ono, Tokyo (JP); Naoki Matsumoto, Tokyo (JP); Kazunori Takahashi, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 23 days.

(21) Appl. No.: 16/240,931

(22) Filed: Jan. 7, 2019

(65) Prior Publication Data

US 2019/0249621 A1 Aug. 15, 2019

(30) Foreign Application Priority Data

Feb. 14, 2018 (JP) ..... 2018-024473

(51) Int. Cl.
*F02M 25/08* (2006.01)

(52) U.S. Cl.
CPC .... *F02M 25/0809* (2013.01); *F02M 25/0836* (2013.01)

(58) Field of Classification Search
CPC . F02M 25/08; F02M 25/0809; F02M 25/0836
USPC .... 123/519–521; 73/114.39, 114.41, 114.45, 73/118.01
See application file for complete search history.

(56) References Cited

U.S. PATENT DOCUMENTS

2006/0179928 A1* 8/2006 Shikama ..... F02M 25/0809 73/114.39
2008/0245347 A1* 10/2008 Collet ..... F02D 41/18 123/520
2014/0224212 A1* 8/2014 Tamura ..... G01M 15/04 123/434
2015/0361929 A1* 12/2015 Tamura ..... F02M 25/0809 73/114.39

FOREIGN PATENT DOCUMENTS

JP 2011-032919 A 2/2011

* cited by examiner

*Primary Examiner* — John Kwon
*Assistant Examiner* — Johnny H Hoang
(74) *Attorney, Agent, or Firm* — Troutman Pepper Hamilton Sanders LLP

(57) ABSTRACT

A purge system malfunction diagnosis device is configured to diagnose a malfunction in a purge system mounted on a vehicle. The purge system includes a canister, a purge passage, a purge valve capable of opening and closing the purge passage, an outside air passage configured to cause the canister to communicate with an outside air opening, an outside air valve capable of opening and closing the outside air passage, and a system pressure sensor configured to detect a pressure in the purge system. In a state where the outside air passage is closed, a diagnosis mode is executed on a basis of a relationship between the pressure in the purge system and an integrated value of flow rate estimates of a purge gas. In the diagnosis mode, a parameter to be used for diagnosing a malfunction in the purge system is adjusted in a case where the flow rate estimate is lower than a flow rate threshold.

14 Claims, 8 Drawing Sheets

PURGE SYSTEM MALFUNCTION DIAGNOSIS DEVICE

CROSS-REFERENCE TO RELATED APPLICATIONS

The present application claims priority from Japanese Patent Application No. 2018-024473 filed on Feb. 14, 2018, the entire contents of which are hereby incorporated by reference.

BACKGROUND

1. Technical Field

The present invention relates to a purge system malfunction diagnosis device.

2. Related Art

A purge system has been used in order to prevent evaporated fuel that is generated in a fuel tank mounted on a vehicle from being released into the outside air. Specifically, the purge system includes a canister that adsorbs evaporated fuel, a purge passage that causes the canister to communicate with an intake pipe of an engine, and a purge valve capable of opening and closing the purge passage (for instance, see Japanese Unexamined Patent Application Publication No. 2011-032919).

In the purge system, the purge valve opens the purge passage, and thereby purge gas that is gas including evaporated fuel adsorbed onto the canister flows into the intake pipe from the purge passage. The purge gas that has flowed into the intake pipe from the purge passage is sent to a combustion chamber of the engine together with intake air that flows in the intake pipe. In addition, flow of the purge gas into the intake pipe from the purge passage enables an amount of evaporated fuel adsorbed onto the canister to be prevented from reaching an upper limit of an amount that can be adsorbed. This makes it possible to continuously prevent evaporated fuel from being released into outside air.

As described above, a purge flow that is a flow of purge gas from the purge passage to the intake pipe has an influence on burning of fuel in the engine and adsorption ability of the canister. In the case where the purge system is malfunctioning, the purge flow is not performed normally, which makes it difficult to appropriately control burning of fuel in the engine and adsorption ability of the canister. Therefore, it is necessary to diagnose a malfunction in the purge system.

Specifically, such diagnosis of a malfunction in the purge system is performed on the basis of the relationship between pressure in the purge system and a flow rate integrated value that is an integrated value of flow rate estimates of purge gas that flows into the intake pipe from the purge passage, in a state where an outside air passage that causes the canister to communicate with an outside air opening is closed by an outside air valve capable of opening and closing the outside air passage. Here, in a state where the outside air passage is closed, the pressure in the purge system basically decreases by an amount of change corresponding to a flow rate of purge gas that flow into the intake pipe from the purge passage. Hence, the flow rate integrated value corresponds to an indicator of an amount of decrease in system pressure when the purge system is normal. Therefore, for instance, in a state where the outside air passage is closed, it may be possible to diagnose a malfunction in the purge system depending on a magnitude of an amount of decrease in the pressure in the purge system with respect to the flow rate integrated value.

SUMMARY OF THE INVENTION

An aspect of the present invention provides a purge system malfunction diagnosis device configured to diagnose a malfunction in a purge system mounted on a vehicle comprising an engine and configured to supply a purge gas including an evaporated fuel generated in a fuel tank to an intake pipe of the engine. The purge system includes a canister configured to adsorb the evaporated fuel, a purge passage configured to cause the canister to communicate with the intake pipe of the engine, a purge valve capable of opening and closing the purge passage, an outside air passage configured to cause the canister to communicate with an outside air opening, an outside air valve capable of opening and closing the outside air passage, and a system pressure sensor configured to detect a pressure in the purge system. The purge system malfunction diagnosis device includes an execution module configured to, in a state where the outside air passage is closed by the outside air valve, execute a diagnosis mode of diagnosing a malfunction in the purge system on a basis of a relationship between the pressure in the purge system and an integrated value of flow rate estimates of a purge gas that flows into the intake pipe from the purge passage by the purge passage being opened by the purge valve. In the diagnosis mode, the execution module adjusts a parameter to be used for diagnosing a malfunction in the purge system in a case where the flow rate estimate is lower than a flow rate threshold.

An aspect of the present invention provides a purge system malfunction diagnosis device configured to diagnose a malfunction in a purge system mounted on a vehicle comprising an engine and configured to supply a purge gas including an evaporated fuel generated in a fuel tank to an intake pipe of the engine. The purge system includes a canister configured to adsorb the evaporated fuel, a purge passage configured to cause the canister to communicate with the intake pipe of the engine, a purge valve capable of opening and closing the purge passage, an outside air passage configured to cause the canister to communicate with an outside air opening, an outside air valve capable of opening and closing the outside air passage, and a system pressure sensor configured to detect a pressure in the purge system. The purge system malfunction diagnosis device includes circuitry configured to, in a state where the outside air passage is closed by the outside air valve, execute a diagnosis mode of diagnosing a malfunction in the purge system on a basis of a relationship between the pressure in the purge system and an integrated value of flow rate estimates of a purge gas that flows into the intake pipe from the purge passage by the purge passage being opened by the purge valve. In the diagnosis mode, the execution module adjusts a parameter to be used for diagnosing a malfunction in the purge system in a case where the flow rate estimate is lower than a flow rate threshold.

DETAILED DESCRIPTION

In the following, some preferred examples of the present invention are described in detail with reference to the accompanying drawings. Note that the following description is directed to illustrative instances of the disclosure and not to be construed as limiting to the present invention. Factors including, without limitation, numerical values, dimensions, shapes, materials, components, positions of the components, and how the components are coupled to each other are for purposes of illustration to give an easier understanding of the present invention, and are not to be construed as limiting to the present invention, unless otherwise specified. Further, elements in the following instances which are not recited in a most-generic independent claim of the disclosure are optional and may be provided on an as-needed basis. The drawings are schematic and are not intended to be drawn to scale. Throughout the specification and the drawings, elements having substantially the same function and configuration are denoted with the same minerals to avoid redundant description. Illustration of elements that are not directly related to the present invention is omitted. In a state where the outside air passage is closed, pressure in the purge system rises in some cases. For instance, in the case where a flow rate of purge gas is relatively small or in the case where a purge flow has not occurred, generation of evaporated fuel in the fuel tank or flow of outside air into the purge system from the outside may cause pressure in the purge system to rise. Hence, pressure in the purge system rises in some cases even though the flow rate integrated value is kept or increasing. This may make it difficult to precisely diagnose a malfunction in the purge system.

It is desirable to provide a novel and improved purge system malfunction diagnosis device capable of precisely diagnosing a malfunction in a purge system.

1. Configuration of Purge System

First, a configuration of a purge system 1 according to an example of the present invention is described with reference to FIGS. 1 to 3.

Figure 1:
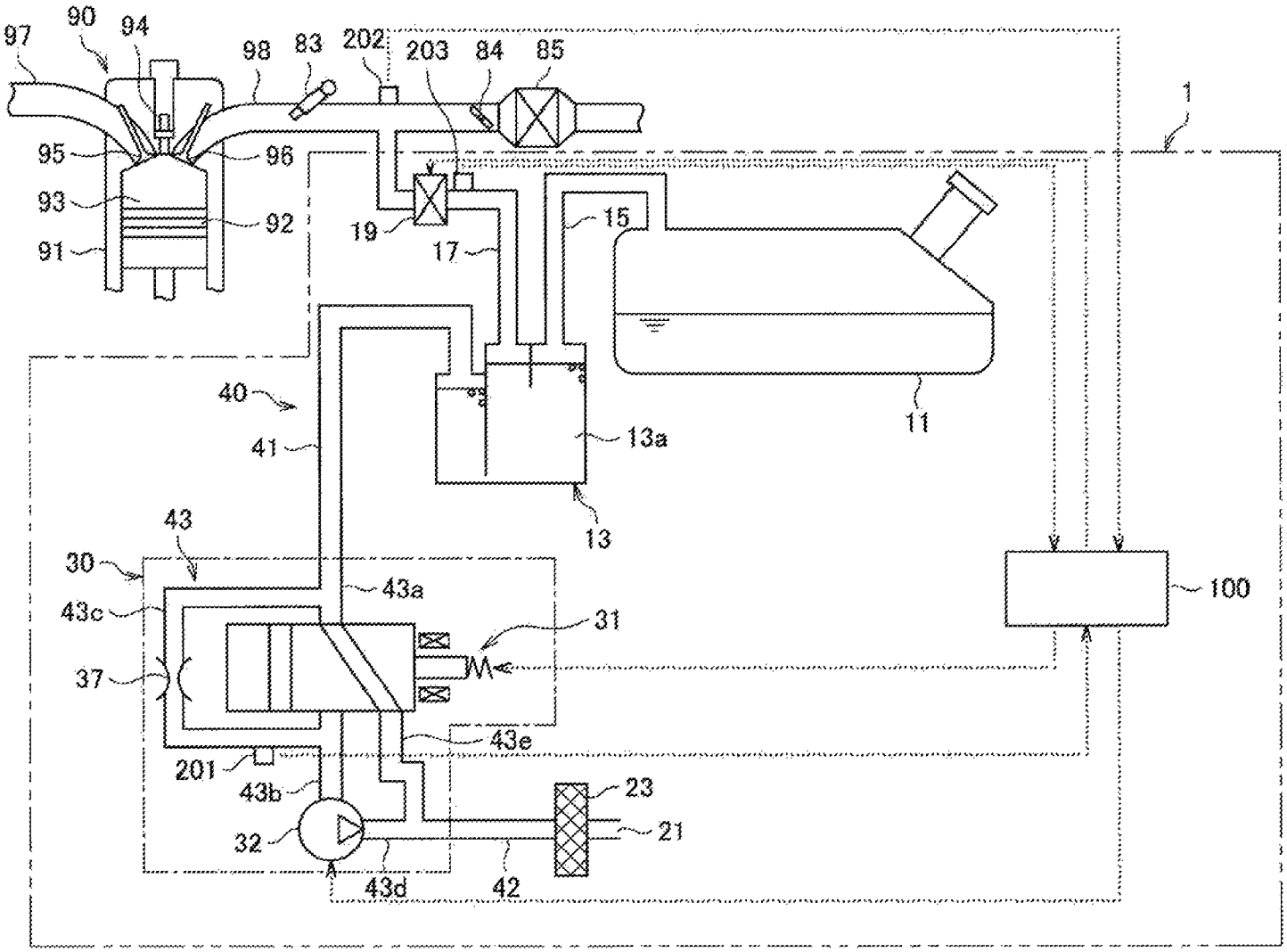
FIG. 1 is a schematic diagram illustrating an instance of a schematic configuration of a purge system according to an example of the present invention.

FIG. 1 is a schematic diagram illustrating an instance of a schematic configuration of the purge system 1 according to the present example. FIG. 2 is a schematic diagram illustrating the purge system 1 according to the present example when an outside air valve 31 is in a closed state. FIG. 3 is a block diagram illustrating an instance of a functional configuration of a control device 100 according to the present example.

The purge system 1 is a system that is mounted on a vehicle that includes an engine, and supplies purge gas including evaporated fuel generated in a fuel tank to an intake pipe of the engine. For instance, as illustrated in FIG. 1, the purge system 1 includes a fuel tank 11, a canister 13, an evaporation passage 15, a purge passage 17, a purge valve 19, an outside air passage 40, a leak detection device 30, and the control device 100. In an example of the present invention, the control device 100 functions as a malfunction diagnosis device that diagnoses a malfunction in the purge system 1.

In addition, FIG. 1 illustrates an instance of an engine 90 to which the purge system 1 is applied.

The engine 90 is, for instance, a spark ignition internal combustion engine. The engine 90 is provided with one or a plurality of cylinders 91. Inside the cylinder 91 is formed a combustion chamber 93, and an ignition plug 94 is provided toward the combustion chamber 93. An intake port and an exhaust port of the cylinder 91 are coupled respectively to an intake pipe 98 and an exhaust pipe 97. Opening and closing of an intake valve 96 and an exhaust valve 95 provided respectively for the intake port and the exhaust port of the cylinder 91 causes intake air to be taken into the combustion chamber 93 and exhaust air to be let out from the combustion chamber 93. In the combustion chamber 93, mixed gas including air and fuel is formed, and the mixed gas is caused to burn by ignition of the ignition plug 94. Thus, a piston 92 makes a linear reciprocating motion in the cylinder 91, and power is transmitted to a crankshaft (not illustrated) coupled to the piston 92.

The intake pipe 98 is coupled to an inlet from which outside air is taken in from the outside of the vehicle. The intake pipe 98 is provided with an air cleaner 85, for instance, and on the downstream side of the intake pipe 98 with respect to the air cleaner 85, a throttle valve 84 capable of adjusting an amount of intake air that is an amount of intake air taken into the intake pipe 98 is provided. On the downstream side of the intake pipe 98 with respect to the throttle valve 84, a fuel injection valve 83 that injects fuel is provided. The fuel injection valve 83 injects, into the intake pipe 98, fuel that is supplied from the fuel tank 11 via an oil path (not illustrated). Note that the fuel injection valve 83 may be provided for the cylinder 91 and be capable of injecting fuel toward the combustion chamber 93. In addition, operation of the fuel injection valve 83 is controlled by, for instance, a control device different from the control device 100. Specifically, the intake pipe 98 branches toward the intake port side of each cylinder 91 of the engine 90, and is coupled to each intake port. To the intake pipe 98 of the engine 90 is coupled the purge passage 17 described later.

The intake pipe 98 is provided with an intake pipe pressure sensor 202 that detects intake pipe pressure that is pressure in the intake pipe 98. Specifically, the intake pipe pressure sensor 202 acquires, as a detection result, a relative value of intake pipe pressure with respect to atmospheric pressure. The intake pipe pressure sensor 202 outputs the acquired detection result. The intake pipe pressure sensor 202 is, for instance, provided in a portion of the intake pipe 98 that is coupled to the purge passage 17.

The fuel tank 11 stores liquid fuel such as gasoline to be supplied to the engine 90. In the fuel tank 11, evaporated fuel is generated by evaporation of part of the liquid fuel. Hence, liquid fuel and evaporated fuel coexist in the fuel tank 11. In addition, the fuel tank 11 communicates with the canister 13 via the evaporation passage 15. Hence, evaporated fuel generated in the fuel tank 11 is guided to the canister 13 via the evaporation passage 15.

The canister 13 adsorbs evaporated fuel. Specifically, the canister 13 adsorbs evaporated fuel guided from the fuel tank 11 via the evaporation passage 15. More specifically, activated carbon 13*a* serving as an adsorbent is provided in the canister 13, and the activated carbon 13*a* adsorbs evaporated fuel guided into the canister 13. The canister 13 communicates with the intake pipe 98 of the engine 90 via the purge passage 17. The purge passage 17 may be, for instance, coupled to a portion of the intake pipe 98 that is on the downstream side with respect to the throttle valve 84 and on the upstream side with respect to the fuel injection valve 83. The purge passage 17 is provided with the purge valve 19.

The purge valve 19 is a control valve capable of opening and closing the purge passage 17. As the purge valve 19, for instance, a control valve capable of adjusting an opening degree between a completely closed state and a completely open state is used. In the case where the purge passage 17 is opened by the purge valve 19, the canister 13 communicates with the intake pipe 98 of the engine 90. In the case where the purge passage 17 is closed by the purge valve 19, the canister 13 is shut off from the intake pipe 98 of the engine 90.

The purge passage 17 is provided with a purge valve opening degree sensor 203 that detects the opening degree of the purge valve 19. The purge valve opening degree sensor 203 outputs an acquired detection result. The purge valve opening degree sensor 203 is provided, for instance, in a portion of the purge passage 17 that is near the purge valve 19.

In addition, the canister 13 communicates with an outside air opening 21 via the outside air passage 40. The outside air opening 21 is an opening that is open to the outside of the vehicle. The outside air passage 40 is provided with the leak detection device 30. Specifically, the outside air passage 40 includes a canister-side passage 41 that couples the canister 13 to the leak detection device 30, an outside air opening-side passage 42 that couples the leak detection device 30 to the outside air opening 21, and an internal passage 43 of the leak detection device 30. The outside air opening-side passage 42 is provided with a drain filter 23.

The leak detection device 30 is a device that detects whether there is a leak of evaporated fuel to the outside from the inside of the purge system 1. A leak of evaporated fuel may occur in the case where, for instance, a through hole penetrating a passage from the inside to the outside is formed in the passage of the purge system 1.

The leak detection device 30 includes, for instance, the internal passage 43, the outside air valve 31, and a pump 32.

The internal passage 43 includes, for instance, a first passage 43*a*, a second passage 43*b*, a third passage 43*c*, a fourth passage 43*d*, and a fifth passage 43*e*. The first passage 43*a* couples the canister-side passage 41 to a port of the outside air valve 31 on the canister 13 side. The second passage 43*b* couples a port of the outside air valve 31 on the outside air opening 21 side to the intake side of the pump 32. The third passage 43*c* causes the first passage 43*a* to communicate with the second passage 43*b*. The third passage 43*c* is provided with an orifice 37. The fourth passage 43*d* couples the discharge side of the pump 32 to the outside air opening-side passage 42. The fifth passage 43*e* couples a port of the outside air valve 31 on the outside air opening 21 side that is different from the port coupled to the second passage 43*b* to the fourth passage 43*d*.

In addition, the internal passage 43 is provided with a system pressure sensor 201 that detects system pressure that is pressure in the purge system 1. Specifically, the system pressure sensor 201 acquires, as a detection result, a relative value of system pressure with respect to atmospheric pressure. The system pressure sensor 201 outputs the acquired detection result. The system pressure sensor 201 is provided, for instance, on the second passage 43*b* side of the third passage 43*c* with respect to the orifice 37.

The outside air valve 31 is a control valve capable of switching a communication state in the internal passage 43 of the leak detection device 30. As the outside air valve 31, for instance, a solenoid valve is used. Specifically, the outside air valve 31 is capable of switching a communication state between a passage coupled to the port on the canister 13 side and a passage coupled to the port on the outside air opening 21 side.

Specifically, as illustrated in FIG. 1, the outside air valve 31 is capable of switching a communication state in the internal passage 43 in a manner that the first passage 43*a* communicates with the fifth passage 43*e*. In the case where the first passage 43*a* communicates with the fifth passage 43*e*, the canister 13 communicates with the outside air opening 21. Hence, in this case, the outside air passage 40 is opened. Note that a state of the outside air valve 31 in this case will be referred to as an open state. Specifically, the outside air valve 31 is in an open state when not energized.

Figure 2:
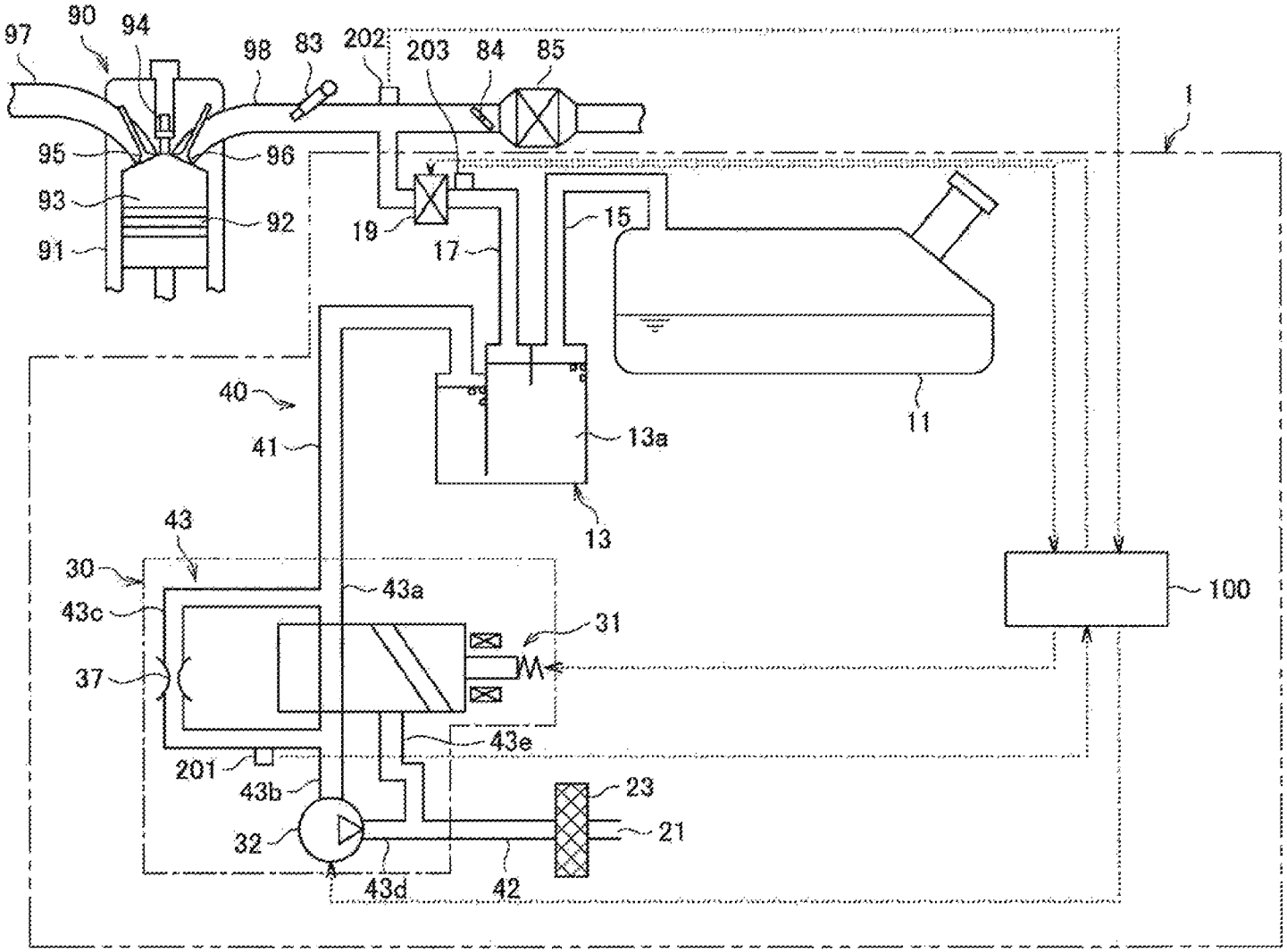
FIG. 2 is a schematic diagram illustrating the purge system according to the example when an outside air valve is in a closed state.

In addition, as illustrated in FIG. 2, the outside air valve 31 is capable of switching a communication state in the internal passage 43 in a manner that the first passage 43*a* communicates with the second passage 43*b*. In the case where the first passage 43*a* communicates with the second passage 43*b*, the canister 13 is shut off from the outside air opening 21. Hence, in this case, the outside air passage 40 is closed. Note that a state of the outside air valve 31 in this case will be referred to as a closed state. Specifically, the outside air valve 31 is in a closed state when energized.

Thus, the outside air valve 31 is a control valve capable of opening and closing the outside air passage 40. Specifically, in normal time when a diagnosis mode described later is not executed, the outside air valve 31 is in an open state, and the outside air passage 40 is opened by the outside air valve 31. At the time of execution of the diagnosis mode described later, the outside air valve 31 is in a closed state, and the outside air passage 40 is closed by the outside air valve 31.

The pump 32 sucks out gas from the intake side to the discharge side. Specifically, as will be described later, in detection of whether there is a leak of evaporated fuel, the pump 32 is driven, and thereby gas in the purge system 1 is sucked out from the second passage 43*b* to the outside of the vehicle via the fourth passage 43*d* and the outside air opening 21.

The control device 100 includes a central processing unit (CPU) being an arithmetic processing unit, a read only memory (ROM) being a memory element that stores programs, calculation parameters etc. that are used by the CPU, a random access memory (RAM) being a memory element that temporarily stores parameters changing as appropriate in execution of the CPU, etc., and the like.

In addition, the control device 10X) receives information output from each device. Communication between the control device 100 and each device is enabled by, for instance, controller area network (CAN) communication. For instance, the control device 100 receives information output from the system pressure sensor 201, the intake pipe pressure sensor 202, and the purge valve opening degree sensor 203.

Figure 3:
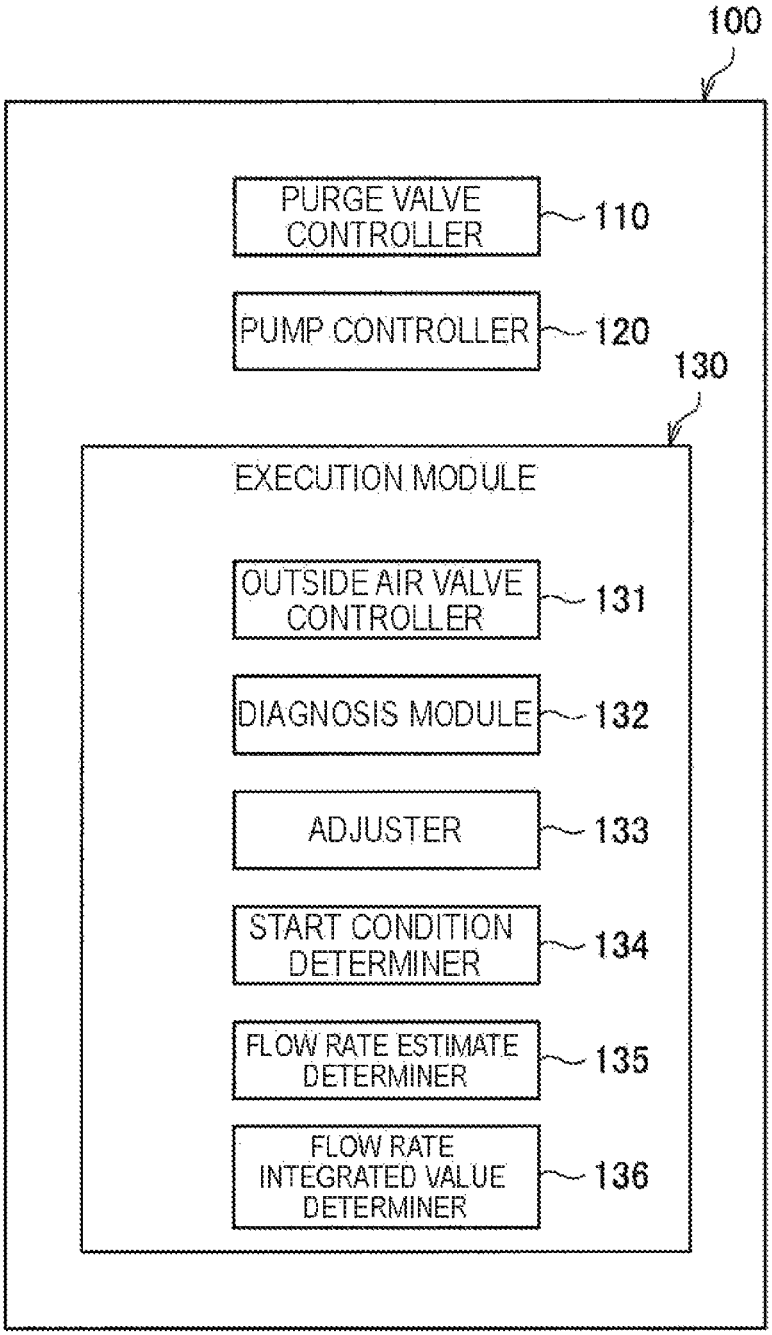
FIG. 3 is a block diagram illustrating an instance of a functional configuration of a control device according to the example.

As illustrated in FIG. 3, the control device 100 includes, for instance, a purge valve controller 110, a pump controller 120, and an execution module 130.

The purge valve controller 110 controls operation of the purge valve 19 by outputting an operation command to the purge valve 19. Thus, a valve opening degree of the purge valve 19 is controlled.

As described above, in the case where the purge passage 17 is opened by the purge valve 19, the canister 13 communicates with the intake pipe 98 of the engine 90. In addition, in normal time when the diagnosis mode described later is not executed, the outside air passage 40 is opened by the outside air valve 31. Hence, system pressure basically is a value relatively close to atmospheric pressure. On the other hand, pressure of the intake pipe 98 is lower than system pressure because of negative pressure generated in the intake pipe 98. Therefore, when the purge passage 17 is opened by the purge valve 19, a purge flow occurs, and purge gas including evaporated fuel flows into the intake pipe 98 from the purge passage 17. Consequently, a flow rate of purge gas that flows into the intake pipe 98 from the purge passage 17 is controlled by the valve opening degree of the purge valve 19 being controlled by the purge valve controller 110.

Specifically, the purge valve controller 110 controls the valve opening degree of the purge valve 19 on the basis of a traveling state of the vehicle. For instance, the purge valve controller 110 causes the purge valve 19 to open the purge passage 17 in the case where there is an acceleration request, and controls the valve opening degree of the purge valve 19 on the basis of an accelerator opening degree, intake pipe pressure, and the like.

The pump controller 120 controls operation of the pump 32 of the leak detection device 30 by outputting an operation command to the pump 32. Thus, sucking out of gas in the purge system 1 to the outside of the vehicle is controlled.

The execution module 130 executes a diagnosis mode of diagnosing a malfunction in the purge system 1. As illustrated in FIG. 3, the execution module 130 includes, for instance, an outside air valve controller 131, a diagnosis module 132, an adjuster 133, a start condition determiner 134, a flow rate estimate determiner 135, and a flow rate integrated value determiner 136.

The outside air valve controller 131 controls operation of the outside air valve 31 of the leak detection device 30 by outputting an operation command to the outside air valve 31. Thus, switching of a communication state in the internal passage 43 of the leak detection device 30 is controlled. Hence, opening and closing of the outside air passage 40 by the outside air valve 31 is controlled.

The diagnosis module 132 diagnoses a malfunction in the purge system 1 in the diagnosis mode. Specifically, the diagnosis module 132 makes a diagnosis that the purge system 1 is malfunctioning in a situation in which a purge flow is not performed normally.

The adjuster 133 adjusts a parameter to be used for diagnosis of a malfunction in the purge system 1 in accordance with a determination result by the flow rate estimate determiner 135. Note that the parameter may be, for instance, stored in a memory element of the control device 100.

The start condition determiner 134, the flow rate estimate determiner 135, and the flow rate integrated value determiner 136 perform various determinations on the basis of information acquired by the control device 100.

The control device 100 may detect whether there is a leak of evaporated fuel to the outside from the inside of the purge system 1 by using the leak detection device 30. Detection processing of a leak of evaporated fuel may be performed, for instance, during a stop of the vehicle.

Specifically, in detection processing of a leak of evaporated fuel, first, the control device 100 brings the purge valve 19 into a closed state and the outside air valve 31 into an open state. Thus, a communication state in the internal passage 43 of the leak detection device 30 enters a state where the first passage 43*a* communicates with the fifth passage 43*e* as illustrated in FIG. 1. Then, the control device 100 drives the pump 32. Hence, evaporated fuel in the third passage 43*c* provided with the orifice 37 is sucked out by the pump 32, and system pressure detected by the system pressure sensor 201 becomes reference pressure corresponding to an inner diameter of the orifice 37.

Next, the control device 100 keeps the purge valve 19 in a closed state, continues driving of the pump 32, and switches the outside air valve 31 to a closed state. Thus, a communication state in the internal passage 43 of the leak detection device 30 enters a state where the first passage 43*a* communicates with the second passage 43*b* as illustrated in FIG. 2. Hence, evaporated fuel in the first passage 43*a* is sucked out by the pump 32 via the second passage 43*b*. System pressure detected by the system pressure sensor 201 in this state will be referred to as determination pressure used for determining whether there is a leak of evaporated fuel. Then, the control device 100 compares the determination pressure with the reference pressure, thereby determining whether there is a leak of evaporated fuel to the outside from the inside of the purge system 1. Specifically, in the case where the determination pressure is higher than the reference pressure, it is determined that there is a leak of evaporated fuel to the outside from the inside of the purge system 1.

Functions of the control device 100 according to the present example may be distributed among a plurality of control devices. In that case, the plurality of control devices may be coupled to each other via a communication bus of a CAN or the like.

2. Operation of Control Device

Now, operation of the control device 100 according to the present example will be described with reference to FIGS. 4 to 9.

Figure 4:
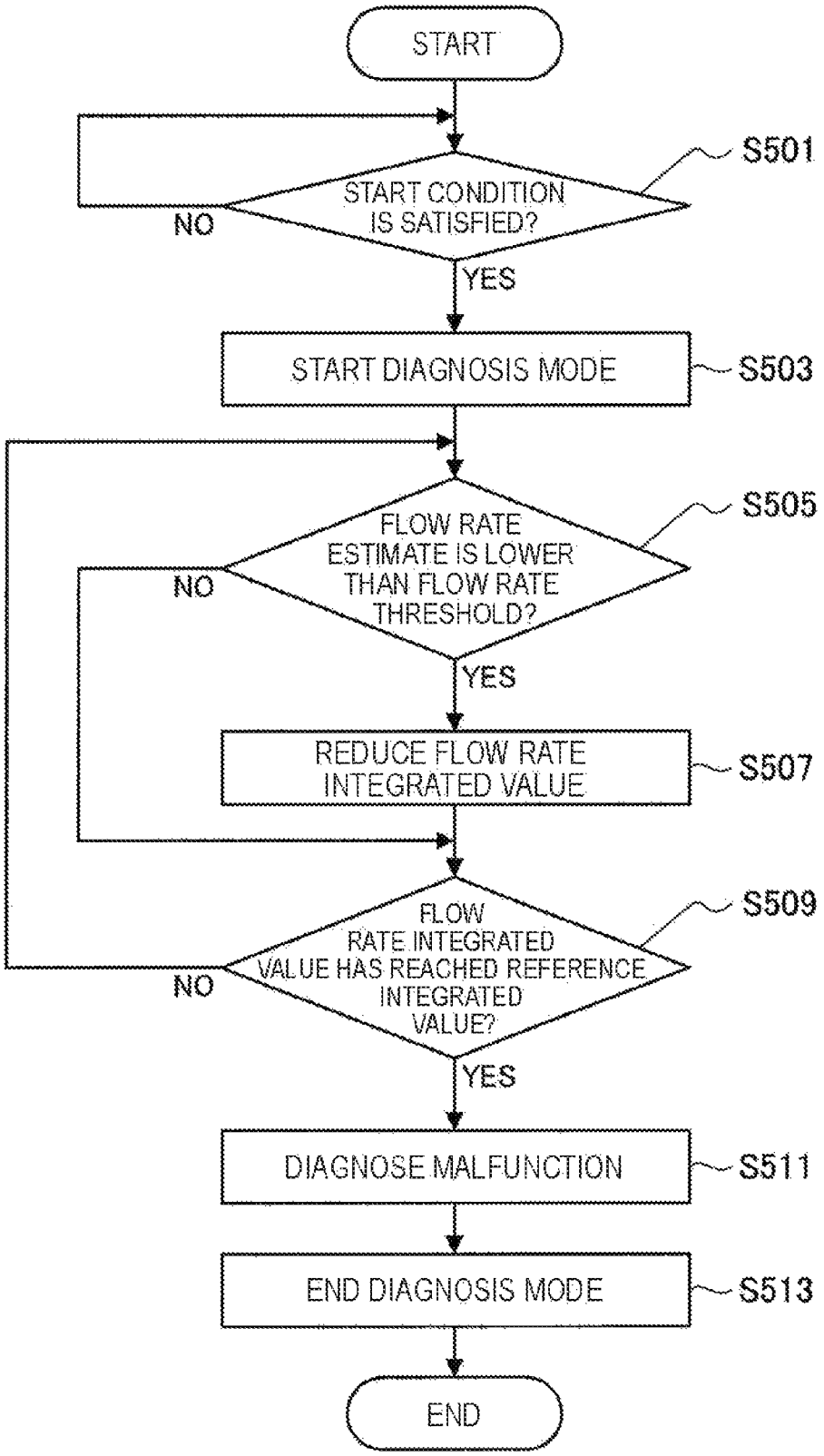
FIG. 4 is a flowchart illustrating an instance of a sequence of processing related to diagnosis performed by the control device according to the example.

FIG. 4 is a flowchart illustrating an instance of a sequence of processing related to diagnosis performed by the control device 100 according to the present example. The processing flow illustrated in FIG. 4 is, for instance, repeated at time intervals set in advance. Note that the processing flow illustrated in FIG. 4 is started in a state where the diagnosis mode is not started. In addition, at the time of execution of the processing flow illustrated in FIG. 4, the valve opening degree of the purge valve 19 is controlled on the basis of a traveling state of the vehicle as described above.

When the control flow illustrated in FIG. 4 is started, first, in step S501, the start condition determiner 134 determines whether a start condition that is a condition under which the diagnosis mode is started is satisfied. In the case where it is determined that the start condition is satisfied (YES in step S501), the processing goes to step S503. In the case where it is determined that the start condition is not satisfied (NO in step S501), the processing in step S501 is repeated.

Specifically, the start condition is a condition that enables determination of whether a state of the purge system 1, such as pressure distribution, temperature distribution, or concentration distribution of evaporated fuel in the purge system 1, is stable enough for the diagnosis mode to be executed appropriately.

For instance, the start condition determiner 134 may apply, as a start condition, elapse of reference time from a point in time when fuel cut of stopping supply of fuel to the engine 90 is started. The reference time may be, for instance, set as appropriate in accordance with design specifications or the like of the vehicle, and stored in a memory element of the control device 100. Specifically, fuel cut is started in the case where there is no longer an acceleration request because accelerator operation is interrupted when the vehicle is traveling. The control device 100 may receive information indicating whether fuel cut is being performed from, for instance, a control device that controls operation of the fuel injection valve 83.

In addition, for instance, the start condition determiner 134 may apply, as a start condition, switching of the purge valve 19 from a closed state to an open state. The purge valve 19 may be, for instance, switched from a closed state to an open state in the case where the vehicle makes a start by accelerator operation being performed when the vehicle is at a stop. In addition, the purge valve 19 may be, for instance, switched from a closed state to an open state in the case where an acceleration request occurs when the vehicle is traveling.

Note that the start condition determiner 134 may apply, as a start condition, the condition exemplified above as a start condition being satisfied and an integrated value of durations of the open state of the purge valve 19 after activation of a system of the vehicle being higher than a predetermined value. The predetermined value may be, for instance, set as appropriate in accordance with design specifications or the like of the vehicle, and stored in a memory element of the control device 100. Specifically, the system of the vehicle is activated by switching of an ignition switch from off to on.

In step S503, the execution module 130 starts the diagnosis mode. When the diagnosis mode is started, the outside air valve controller 131 brings the outside air valve 31 into a closed state. Thus, as illustrated in FIG. 2, the first passage 43*a* communicates with the second passage 43*b*, which causes the canister 13 to be shut off from the outside air opening 21, and the outside air passage 40 is closed. In addition, when the diagnosis mode is started, integration of flow rate estimates of purge gas (gas including evaporated fuel) that flows into the intake pipe 98 from the purge passage 17 by the purge passage 17 being opened by the purge valve 19 is started. This will be described in detail later.

Next, in step S505, the flow rate estimate determiner 135 determines whether a flow rate estimate of purge gas that flows into the intake pipe 98 is lower than a flow rate threshold. In the case where it is determined that the flow rate estimate is lower than the flow rate threshold (YES in step S505), the processing goes to step S507. In the case where it is determined that the flow rate estimate is not lower than the flow rate threshold (NO in step S505), the processing goes to step S509.

Specifically, the flow rate estimate is a value estimated as a flow rate of purge gas that flows into the intake pipe 98 from the purge passage 17 when the purge system 1 is normal and a purge flow is performed normally. Specifically, the flow rate threshold may be set to a value that enables determination of whether the flow rate estimate is small enough for system pressure to rise by generation of evaporated fuel in the fuel tank 11 or flow of outside air into the purge system 1 from the outside, and stored in a memory element of the control device 100. Note that in a state where the outside air passage 40 is closed by the outside air valve 31, for instance, outside air may flow into the purge system 1 from the outside through the pump 32.

For instance, the flow rate estimate determiner 135 calculates the flow rate estimate of purge gas on the basis of intake pipe pressure and an opening degree of the purge valve 19. Specifically, the flow rate estimate determiner 135 works out, by calculation, a larger value as the flow rate estimate of purge gas as the intake pipe pressure is lower. In addition, the flow rate estimate determiner 135 works out, by calculation, a larger value as the flow rate estimate of purge gas as the opening degree of the purge valve 19 is larger. The flow rate estimate determiner 135 may calculate the flow rate estimate of purge gas further on the basis of system pressure. Specifically, the flow rate estimate determiner 135 works out, by calculation, a larger value as the flow rate estimate of purge gas as a difference between the system pressure and the intake pipe pressure is larger.

Note that the flow rate estimate calculated at each time is used for calculation of a flow rate integrated value by the flow rate integrated value determiner 136 described later, and may be stored in a memory element of the control device 100, for instance.

In step S507, the adjuster 133 reduces a flow rate integrated value that is an integrated value of flow rate estimates of purge gas. The flow rate integrated value corresponds to an instance of a parameter to be used in diagnosis of a malfunction in the purge system 1 by the diagnosis module 132. Note that as will be described later, the flow rate integrated value may be updated at each time by the flow rate integrated value determiner 136, and stored in a memory element of the control device 100, for instance. In addition, the flow rate integrated value may be reset with the end of the diagnosis mode, and set to 0 at the start of the diagnosis mode.

For instance, the adjuster 133 reduces the flow rate integrated value by a larger decrease as the flow rate estimate is smaller. Specifically, the adjuster 133 reduces the flow rate integrated value by a larger decrease as the flow rate estimate is closer to 0, and reduces the flow rate integrated value by a smaller decrease as the flow rate estimate is closer to the flow rate threshold. For instance, the adjuster 133 reduces the flow rate integrated value by a decrease corresponding to the flow rate estimate calculated for the current time by the flow rate estimate determiner 135.

In the case where the flow rate estimate is lower than the flow rate threshold, generation of evaporated fuel in the fuel tank 11 or flow of outside air into the purge system 1 from the outside may cause system pressure to rise. Hence, in such a case, reducing the flow rate integrated value corresponding to an indicator of an amount of decrease in system pressure when the purge system 1 is normal enables adjustment of the flow rate integrated value in which a rise in system pressure is reflected. In this manner, the adjuster 133 adjusts a parameter so as to reflect a rise in system pressure.

In this specification, description is given mainly on an instance in which the flow rate integrated value serving as a parameter to be used in diagnosis of a malfunction in the purge system 1 is adjusted by the adjuster 133 in the case where the flow rate estimate is lower than the flow rate threshold, but a parameter adjusted by the adjuster 133 is not limited to such an instance. For instance, the adjuster 133 may increase the reference integrated value serving as a parameter in the case where the flow rate estimate is lower than the flow rate threshold. In addition, for instance, the adjuster 133 may increase a pressure threshold serving as a parameter in the case where the flow rate estimate is lower than the flow rate threshold. Also in such instances in which a parameter such as the reference integrated value or the pressure threshold is adjusted, the parameter is adjusted so as to reflect a rise in system pressure in the case where the flow rate estimate is lower than the flow rate threshold.

Next, in step S509, the flow rate integrated value determiner 136 determines whether a flow rate integrated value that is an integrated value of flow rate estimates of purge gas has reached a reference integrated value. In the case where it is determined that the flow rate integrated value has reached the reference integrated value (YES in step S509), the processing goes to step S511. In the case where it is determined that the flow rate integrated value has not reached the reference integrated value (NO in step S509), the processing returns to step S505.

Specifically, the reference integrated value may be set to a value that enables determination of whether the flow rate integrated value is large enough for a malfunction in the purge system 1 to be diagnosed appropriately, and stored in a memory element of the control device 100.

The flow rate integrated value determiner 136 may calculate the flow rate integrated value by, for instance, adding the flow rate estimate calculated for the current time to the flow rate integrated value stored in the memory element of the control device 100X). In addition, the flow rate integrated value determiner 136 overwrites the flow rate integrated value stored in the memory element of the control device 100 with the calculated value. In this manner, the flow rate integrated value determiner 136 updates the flow rate integrated value stored in the memory element of the control device 100 at each time, for instance.

In step S511, the diagnosis module 132 diagnoses a malfunction in the purge system 1. Specifically, the diagnosis module 132 diagnoses a malfunction in the purge system 1 on the basis of the relationship between a flow rate integrated value and system pressure. As described above, when the diagnosis mode is started, the outside air valve 31 enters a closed state. Hence, in a state where the outside air passage 40 is closed by the outside air valve 31, the diagnosis module 132 diagnoses a malfunction in the purge system 1 on the basis of the relationship between the flow rate integrated value and the system pressure.

For instance, in the case where system pressure when the flow rate integrated value has reached the reference integrated value is higher than a pressure threshold, the diagnosis module 132 makes a diagnosis that the purge system 1 is malfunctioning. Specifically, the pressure threshold may be set to a value that enables determination of whether an amount of decrease in system pressure until the flow rate integrated value reaches the reference integrated value is large enough for a determination that a purge flow is performed normally to be made, and stored in a memory element of the control device 100.

Figure 5:
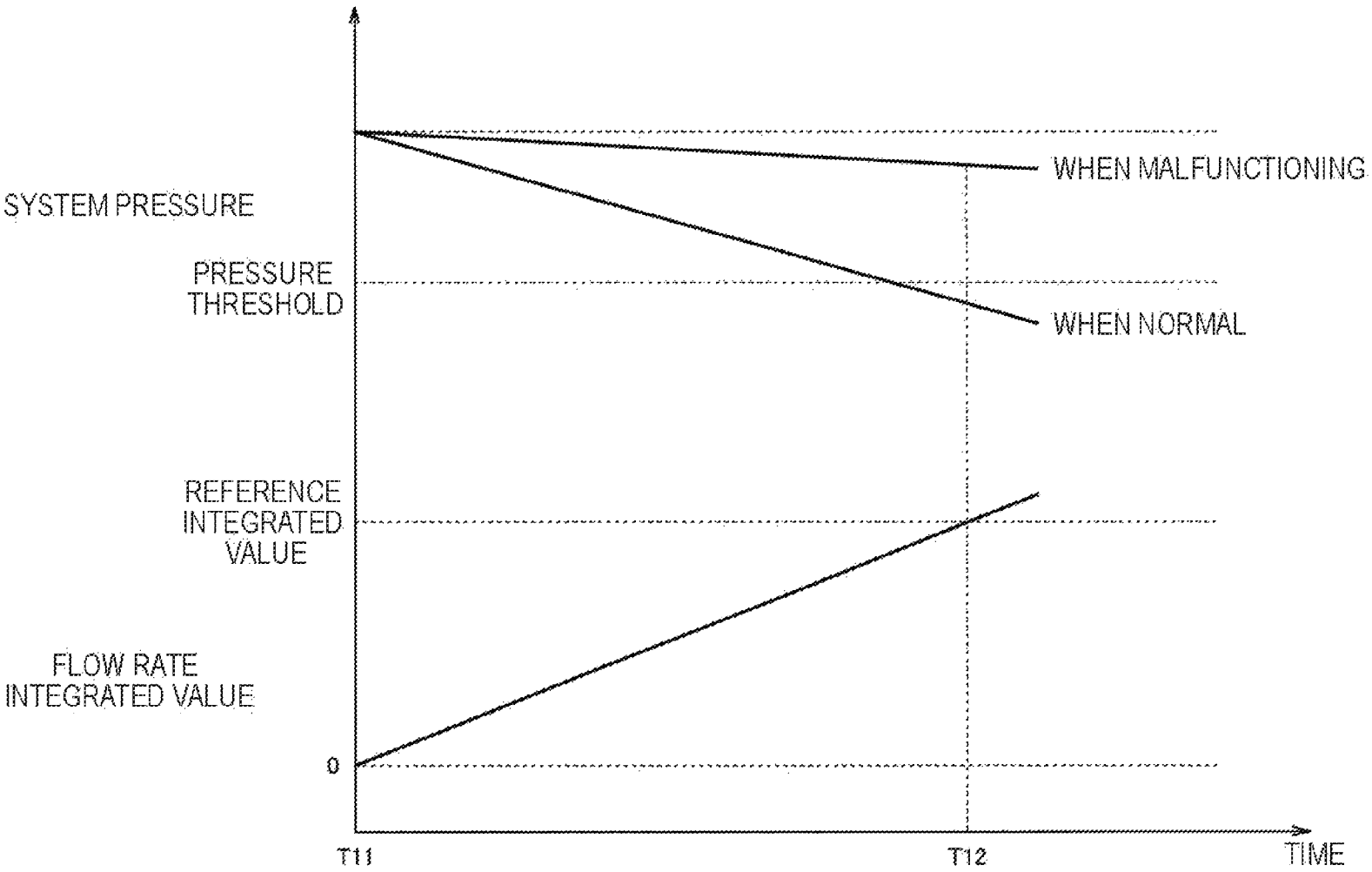
FIG. 5 is an explanatory diagram illustrating an instance of progression of system pressure and a flow rate integrated value in a diagnosis mode.

FIG. 5 is an explanatory diagram illustrating an instance of progression of system pressure and a flow rate integrated value in the diagnosis mode. In the case where the purge valve 19 is in an open state, a purge flow occurs, so that purge gas flows into the intake pipe 98 from the purge passage 17. Hence, for instance, in the case where the diagnosis mode is started at time T11, and the purge valve 19 continues to be in an open state after time T11, the flow rate integrated value may increase continuously after time T11, as illustrated in FIG. 5. Then, at time T12 when the flow rate integrated value reaches the reference integrated value, the flow rate integrated value determiner 136 determines that the flow rate integrated value has reached the reference integrated value. Thus, the diagnosis module 132 diagnoses a malfunction in the purge system 1 at time T12.

In the diagnosis mode, the outside air passage 40 is closed by the outside air valve 31. Hence, in the case where the purge valve 19 is in an open state, system pressure basically decreases by purge gas flowing into the intake pipe 98 from the purge passage 17. Hence, as illustrated in FIG. 5, system pressure may continuously decrease after time T11. Here, when the purge system 1 is malfunctioning and a purge flow is not performed normally (e.g., when a passage in the purge system 1 is clogged with a foreign body), a decrease speed of system pressure in the diagnosis mode is smaller than that when the purge system 1 is normal. Hence, when the purge system 1 is malfunctioning, system pressure is higher than the pressure threshold at time T12. On the other hand, when the purge system 1 is normal, a decrease speed of system pressure in the diagnosis mode is larger than that when the purge system 1 is malfunctioning. Hence, when the purge system 1 is normal, system pressure is equal to or less than the pressure threshold at time T12. Thus, the diagnosis module 132 can diagnose a malfunction in the purge system 1.

Note that in the case where a diagnosis that the purge system 1 is malfunctioning is made, the control device 100 reports a diagnosis result to a driver, for instance. In that case, specifically, the control device 100 may report to the driver that the purge system 1 is malfunctioning by controlling display by a display device such as a lamp or a display provided in the vehicle.

Next, in step S513, the execution module 130 ends the diagnosis mode. When the diagnosis mode ends, the outside air valve controller 131 switches the outside air valve 31 from a closed state to an open state. Thus, as illustrated in FIG. 1, the first passage 43*a* communicates with the fifth passage 43*e*, which causes the canister 13 to communicate with the outside air opening 21, and the outside air passage 40 is opened. In addition, the execution module 130 resets the flow rate integrated value.

Next, the processing flow illustrated in FIG. 4 ends.

Now, description will be given on a correspondence between progression of each state in the vehicle and progression of system pressure and a flow rate integrated value in regard to cases where diagnosis modes according to a reference example and the present example are executed. Note that, strictly speaking, there may be a gap in time of change between states that are described as changing at the same time in the following description.

Figure 6:
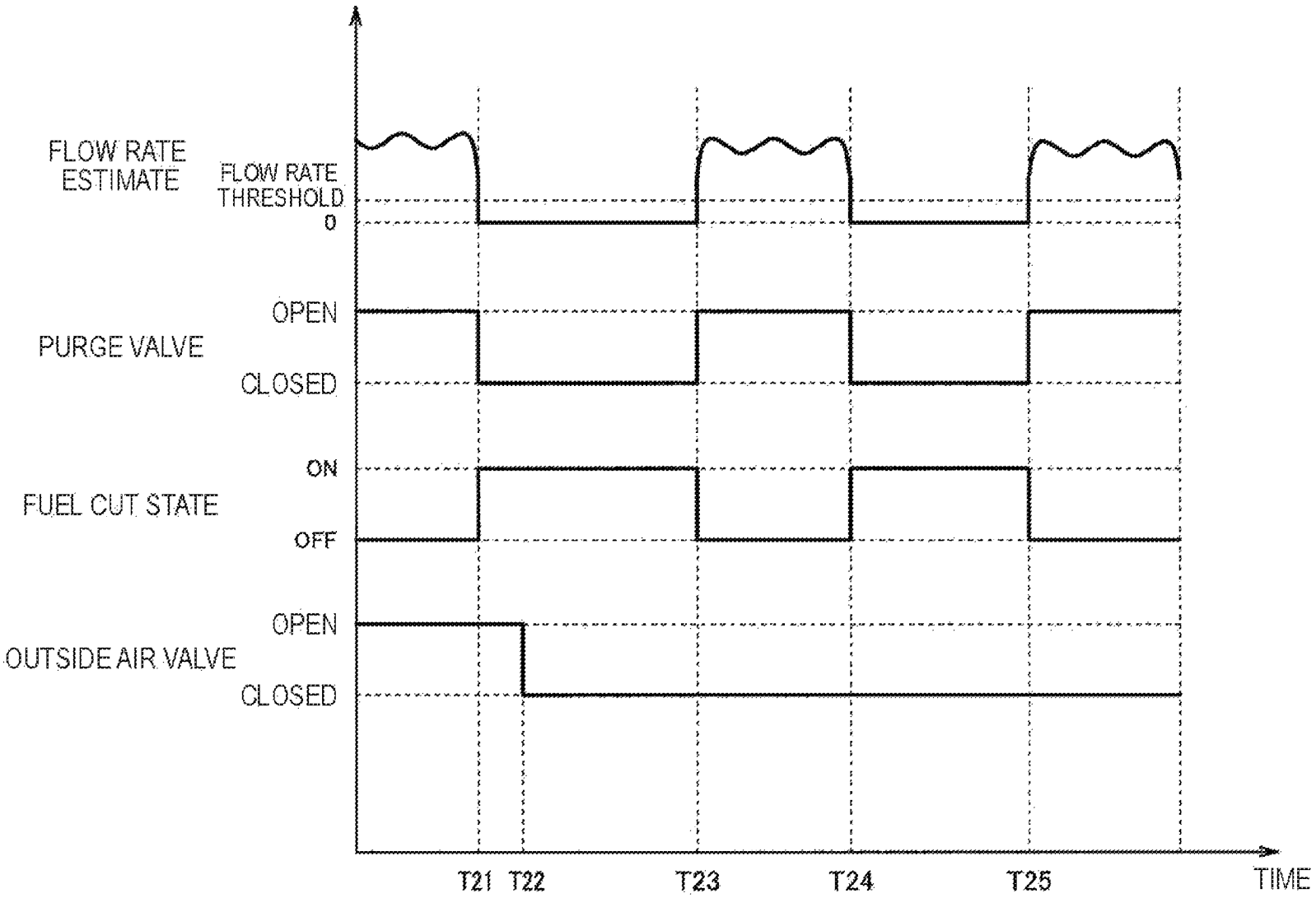
FIG. 6 is an explanatory diagram illustrating an instance of progression of each state in a vehicle.

FIG. 6 is an explanatory diagram illustrating an instance of progression of each state in the vehicle. Specifically, FIG. 6 illustrates, as the states in the vehicle, flow rate estimates of purge gas, an open/closed state of the purge valve 19, an execution state of fuel cut, and an open/closed state of the outside air valve 31. In addition, FIG. 6 illustrates progression of each state when elapse of reference time from a point in time when fuel cut of stopping supply of fuel to the engine 90 is started is applied as a start condition that is a condition under which the diagnosis mode is started.

Figure 7:
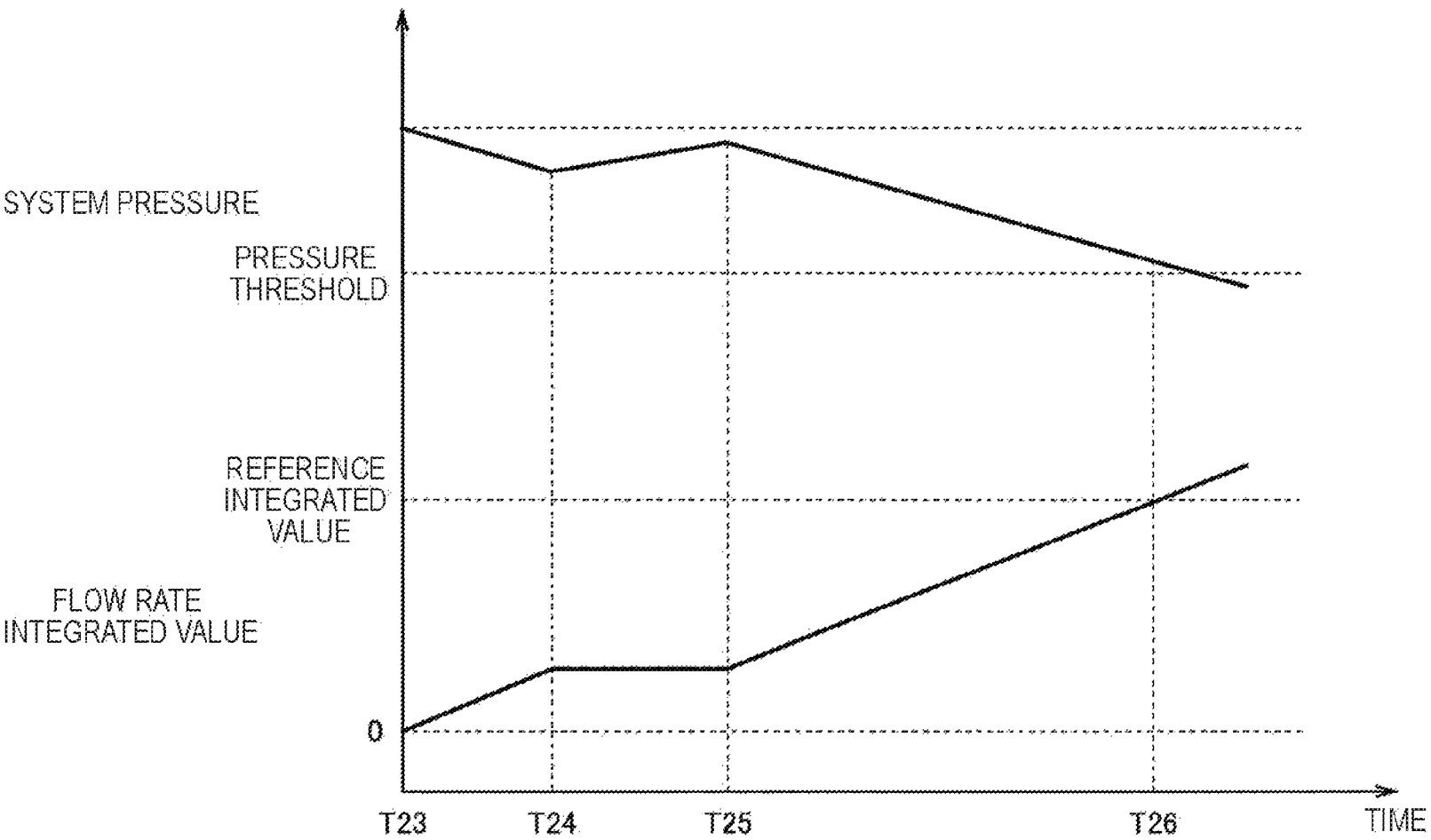
FIG. 7 is an explanatory diagram illustrating an instance of progression of system pressure and a flow rate integrated value corresponding to progression of each state illustrated in FIG. 6 in regard to a case where a diagnosis mode according to a reference example is executed.
Figure 8:
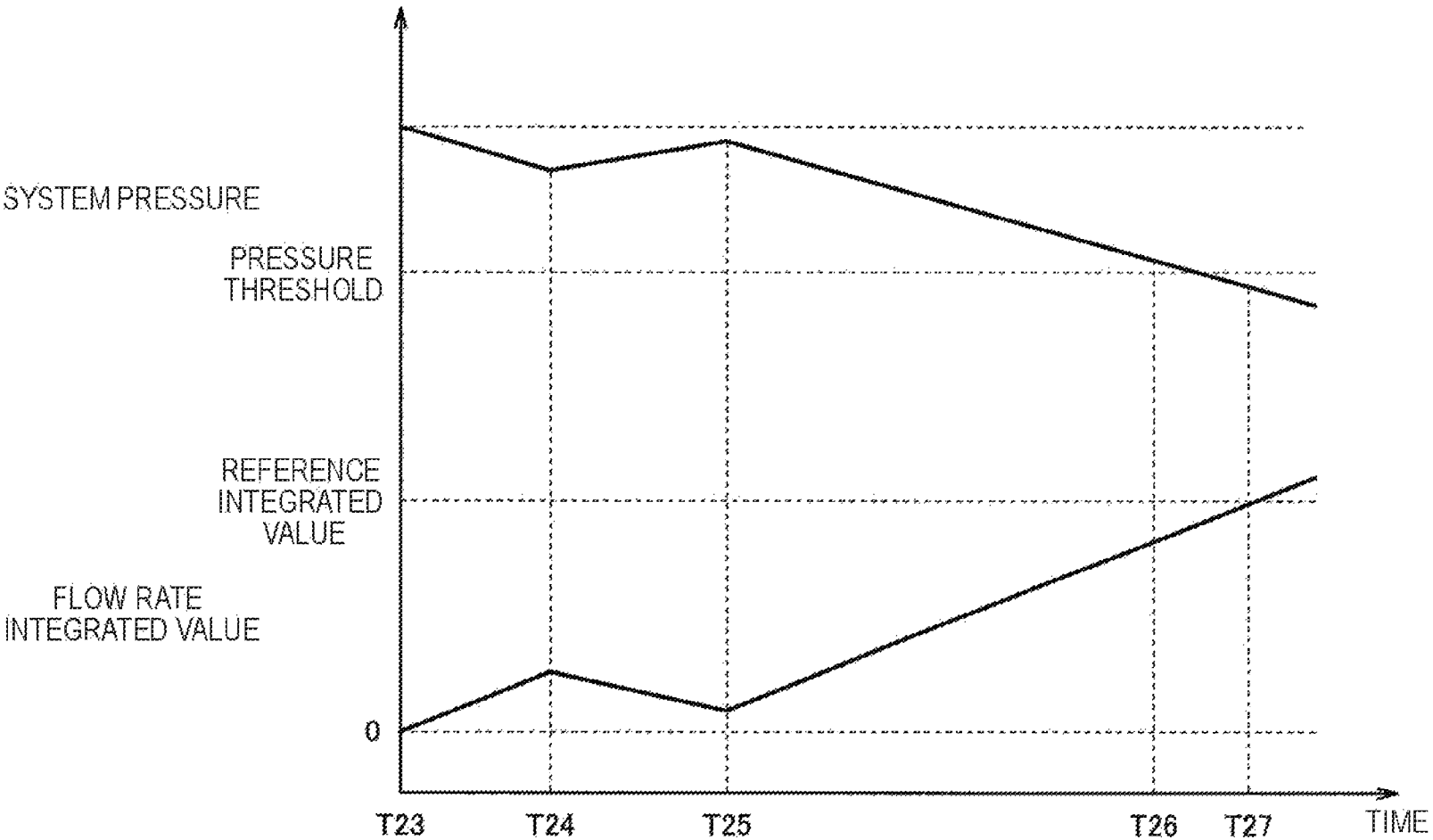
FIG. 8 is an explanatory diagram illustrating an instance of progression of system pressure and a flow rate integrated value corresponding to progression of each state illustrated in FIG. 6 in regard to a case where a diagnosis mode according to an example of the present invention is executed.

FIG. 7 is an explanatory diagram illustrating an instance of progression of system pressure and a flow rate integrated value corresponding to progression of each state illustrated in FIG. 6 in regard to a case where a diagnosis mode according to a reference example is executed. FIG. 8 is an explanatory diagram illustrating an instance of progression of system pressure and a flow rate integrated value corresponding to progression of each state illustrated in FIG. 6 in regard to a case where a diagnosis mode according to the present example is executed. Specifically, FIGS. 7 and 8 illustrate progression of system pressure and a flow rate integrated value when the purge system 1 is normal.

In the reference example, as in the present example, a diagnosis mode of diagnosing a malfunction in the purge system 1 is executed on the basis of the relationship between the flow rate integrated value and the system pressure in a state where the outside air passage 40 is closed by the outside air valve 31. However, in the reference example, unlike the present example, adjustment processing of a parameter to be used in diagnosis of a malfunction in the purge system 1 is not performed even in the case where the flow rate estimate of purge gas is lower than the flow rate threshold.

For instance, as illustrated in FIG. 6, at time T21 while the vehicle is traveling, fuel cut is started. Then, at time T22 when reference time has elapsed from time T21, the diagnosis mode is started by the start condition being satisfied, and the outside air valve 31 is switched from an open state to a closed state. Thus, the outside air passage 40 is closed by the outside air valve 31. After that, in a state where the outside air passage 40 is closed by the outside air valve 31, the valve opening degree of the purge valve 19 is controlled on the basis of a traveling state of the vehicle. For instance, in FIG. 6, the purge valve 19 is switched from a closed state to an open state at time T23. After that, the purge valve 19 is in a closed state between time T24 and time T25, and is in an open state after time T25.

In the reference example, in the case where each state of the vehicle undergoes a progression as illustrated in FIG. 6, for instance, system pressure and a flow rate integrated value undergo a progression as illustrated in FIG. 7. Specifically, as illustrated in FIG. 7, an increase in flow rate integrated value and a decrease in system pressure proceed between time T23 and time T24 when the purge valve 19 is in an open state. Then, between time T24 and time T25 when the purge valve 19 is in a closed state, the flow rate estimate is 0; hence, the flow rate integrated value is kept in the reference example. Here, between time T24 and time T25, generation of evaporated fuel in the fuel tank 11 or flow of outside air into the purge system 1 from the outside causes system pressure to rise. Then, at time T25, a purge flow occurs by the purge valve 19 being switched from a closed state to an open state, so that an increase in flow rate integrated value and a decrease in system pressure start again. After that, at time T26 when the flow rate integrated value reaches the reference integrated value, diagnosis processing of a malfunction in the purge system 1 is executed.

In the reference example, as described above, between time T24 and time T25, adjustment processing of the flow rate integrated value serving as a parameter to be used in diagnosis of a malfunction in the purge system 1 is not performed, and the flow rate integrated value is kept. On the other hand, between time T24 and time T25, system pressure rises even though the flow rate integrated value is kept. Thus, at time T26 when diagnosis processing of a malfunction in the purge system 1 is executed, system pressure may be higher than the pressure threshold, as illustrated in FIG. 7. Hence, a diagnosis that the purge system 1 is malfunctioning may be made even though a purge flow is performed normally.

In the present example, in the case where each state of the vehicle undergoes a progression as illustrated in FIG. 6, for instance, system pressure and a flow rate integrated value undergo a progression as illustrated in FIG. 8. Specifically, as illustrated in FIG. 8, an increase in flow rate integrated value and a decrease in system pressure proceed between time T23 and time T24 when the purge valve 19 is in an open state. Then, between time T24 and time T25 when the purge valve 19 is in a closed state, the flow rate estimate is below the flow rate threshold; hence, the flow rate integrated value is reduced by adjustment processing performed by the adjuster 133 in the present example. Here, between time T24 and time T25, system pressure rises as described above. Then, at time T25, a purge flow occurs by the purge valve 19 being switched from a closed state to an open state, so that an increase in flow rate integrated value and a decrease in system pressure start again. After that, at time T27 when the flow rate integrated value reaches the reference integrated value, diagnosis processing of a malfunction in the purge system 1 by the diagnosis module 132 is executed.

In the present example, as described above, between time T24 and time T25, adjustment processing of the flow rate integrated value serving as a parameter to be used in diagnosis of a malfunction in the purge system 1 is performed, and the flow rate integrated value is reduced. Thus, at time T25 when an increase in flow rate integrated value starts again, the flow rate integrated value is smaller than in the reference example. Hence, at time T27, which is after time T26 when the flow rate integrated value reaches the reference integrated value in the reference example, the flow rate integrated value reaches the reference integrated value. Therefore, at time T27 when diagnosis processing of a malfunction in the purge system 1 is executed, system pressure may be equal to or less than the pressure threshold, as illustrated in FIG. 8. Hence, in the case where a purge flow is performed normally, a diagnosis can be appropriately made that the purge system 1 is not malfunctioning.

Note that although an instance in which the flow rate estimate is below the flow rate threshold when the purge valve 19 is in a closed state is described above with reference to FIGS. 6 to 8, the flow rate estimate may be lower than the flow rate threshold even when the purge valve 19 is in an open state. Specifically, in the case where an opening degree of the purge valve 19 is relatively small, the flow rate estimate may be lower than the flow rate threshold. As described above, the adjuster 133 may reduce the flow rate integrated value in the case where the flow rate estimate is below the flow rate threshold even when the purge valve 19 is in an open state. In addition, in this case, the adjuster 133 may reduce the flow rate integrated value by a decrease corresponding to the flow rate estimate, as described above.

3. Effect of Control Device

Now, an effect of the control device 100 according to the present example will be described.

In the control device 100 according to the present example, the diagnosis mode of diagnosing a malfunction in the purge system 1 is executed on the basis of the relationship between a flow rate integrated value that is an integrated value of flow rate estimates of purge gas and system pressure in a state where the outside air passage 40 is closed by the outside air valve 31. In addition, in the diagnosis mode, a parameter to be used in diagnosis of a malfunction in the purge system 1 is adjusted in the case where the flow rate estimate of purge gas is lower than the flow rate threshold. Thus, a malfunction in the purge system 1 can be diagnosed appropriately in accordance with a rise in system pressure that may occur during execution of the diagnosis mode. This makes it possible to precisely diagnose a malfunction in the purge system 1.

In particular, in the control device 100 according to the present example, in the case of continuing the diagnosis mode even when the purge valve 19 is switched to a closed state for the purpose of speedily completing diagnosis of a malfunction in the purge system 1, a malfunction in the purge system 1 can be diagnosed appropriately in accordance with a rise in system pressure that may occur during execution of the diagnosis mode.

In addition, in the control device 100 according to the present example, in the diagnosis mode, a parameter may be adjusted so as to reflect a rise in system pressure in the case where the flow rate estimate of purge gas is lower than the flow rate threshold. Thus, a malfunction in the purge system 1 can be diagnosed more appropriately in accordance with a rise in system pressure that may occur during execution of the diagnosis mode.

In addition, in the control device 100 according to the present example, in the diagnosis mode, in the case where system pressure when the flow rate integrated value has reached the reference integrated value is higher than a pressure threshold, a diagnosis that the purge system 1 is malfunctioning may be made. This makes it possible to appropriately make a diagnosis that the purge system 1 is malfunctioning in a situation in which a purge flow is not performed normally.

In addition, in the control device 100 according to the present example, in the diagnosis mode, the flow rate integrated value serving as a parameter to be used in diagnosis of a malfunction in the purge system 1 may be reduced in the case where the flow rate estimate of purge gas is lower than the flow rate threshold. Thus, without an increase in pressure threshold, a malfunction in the purge system 1 can be diagnosed appropriately in accordance with a rise in system pressure that may occur during execution of the diagnosis mode. This makes it possible to further precisely diagnose a malfunction in the purge system 1.

In addition, in the control device 100 according to the present example, in the diagnosis mode, the flow rate integrated value may be reduced by a larger decrease as the flow rate estimate of purge gas is smaller in the case where the flow rate estimate of purge gas is lower than the flow rate threshold. Thus, the flow rate integrated value serving as a parameter to be used in diagnosis of a malfunction in the purge system 1 can be adjusted precisely in accordance with the flow rate estimate of purge gas. This makes it possible to further precisely diagnose a malfunction in the purge system 1.

In addition, in the control device 100 according to the present example, the flow rate estimate of purge gas may be calculated on the basis of intake pipe pressure and an opening degree of the purge valve 19. This makes it possible to appropriately calculate the flow rate estimate of purge gas and the flow rate integrated value in the diagnosis mode. Furthermore, in the adjustment of the flow rate integrated value serving as a parameter to be used in diagnosis of a malfunction in the purge system 1, the flow rate integrated value can be reduced by an appropriate decrease.

In addition, in the control device 100 according to the present example, the flow rate estimate of purge gas may be calculated on the basis of system pressure. This makes it possible to precisely calculate the flow rate estimate of purge gas and the flow rate integrated value in the diagnosis mode. Furthermore, precision of a decrease in the adjustment of the flow rate integrated value serving as a parameter to be used in diagnosis of a malfunction in the purge system 1 can be further improved.

4. Conclusion

As described above, according to the present example, the execution module 130 of the control device 100 executes the diagnosis mode of diagnosing a malfunction in the purge system 1 on the basis of the relationship between a flow rate integrated value that is an integrated value of flow rate estimates of purge gas and system pressure in a state where the outside air passage 40 is closed by the outside air valve 31. In addition, in the diagnosis mode, the execution module 130 adjusts a parameter to be used in diagnosis of a malfunction in the purge system 1 in the case where the flow rate estimate of purge gas is lower than the flow rate threshold. Thus, a malfunction in the purge system 1 can be diagnosed appropriately in accordance with a rise in system pressure that may occur during execution of the diagnosis mode. This makes it possible to precisely diagnose a malfunction in the purge system 1.

In particular, according to the present example, in the case of continuing the diagnosis mode even when the purge valve 19 is switched to a closed state for the purpose of speedily completing diagnosis of a malfunction in the purge system 1, a malfunction in the purge system 1 can be diagnosed appropriately in accordance with a rise in system pressure that may occur during execution of the diagnosis mode.

A specific configuration example of the purge system 1 is described above with reference to FIG. 1, but a purge system according to an example of the present invention is not limited to such an instance. For instance, the leak detection device 30 may be omitted from the configuration of the purge system 1. In that case, for instance, the outside air passage 40 that causes the canister 13 to communicate with the outside air opening 21 is provided with an outside air valve capable of opening and closing the outside air passage 40. In addition, dimensions and shapes of the components, positional relationships between the components, and paths of the passages illustrated in FIG. 1 are merely instances, and are not limited to such instances.

In addition, the control device 100 is described above as an instance of a device that functions as a malfunction diagnosis device, but the device that functions as a malfunction diagnosis device is not limited to such an instance. For instance, the device that functions as a malfunction diagnosis device does not need to have functions of the purge valve controller 110 and the pump controller 120 in the control device 100.

Note that it is not necessary for the processing described in this specification with reference to the flowchart to be executed in the order illustrated in the flowchart. Some processing steps may be performed in parallel. Further, some of additional steps can be adopted, or some processing steps can be omitted.

Although the preferred examples of the present invention have been described in detail with reference to the appended drawings, the present invention is not limited thereto. It is obvious to those skilled in the art that various modifications or variations are possible insofar as they are within the technical scope of the appended claims or the equivalents thereof. It should be understood that such modifications or variations are also within the technical scope of the present invention.

The invention claimed is:

1. A purge system malfunction diagnosis device configured to diagnose a malfunction in a purge system mounted on a vehicle comprising an engine and configured to supply a purge gas including an evaporated fuel generated in a fuel tank to an intake pipe of the engine, the purge system comprising a canister configured to adsorb the evaporated fuel, a purge passage configured to cause the canister to communicate with the intake pipe of the engine, a purge valve capable of opening and closing the purge passage, an outside air passage configured to cause the canister to communicate with an outside air opening, an outside air valve capable of opening and closing the outside air passage, and a system pressure sensor configured to detect a pressure in the purge system, the purge system malfunction diagnosis device comprising an execution module configured to, in a state where the outside air passage is closed by the outside air valve, diagnose a malfunction in the purge system by:

calculating an integrated value of flow rate estimates of a purge gas that flows into the intake pipe from the purge passage, when the purge passage is opened by the purge valve, comparing the integrated value of the flow rate estimates with a reference integrated value;

comparing the pressure in the purge system as detected by the system pressure sensor with a pressure threshold when the integrated value of the flow rate estimates has reached the reference integrated value;

determining an occurrence of the malfunction when the pressure in the purge system as detected by the system pressure sensor is higher than the pressure threshold at the time the integrated value of the flow rate estimates has reached the reference integrated value; and reducing the integrated value of the flow rate estimates when a flow rate estimate is lower than a predetermined flow rate threshold.

2. The purge system malfunction diagnosis device according to claim 1, wherein in the diagnosis mode, the execution module adjusts the integrated value of the flow rate estimates so as to reflect a rise in the pressure in the purge system in the case where the flow rate estimate is lower than the flow rate threshold.

3. The purge system malfunction diagnosis device according to claim 1, wherein in the diagnosis mode, the execution module reduces the integrated value of the flow rate estimates by a larger decrease as the flow rate estimate is smaller in the case where the flow rate estimate is lower than the flow rate threshold.

4. The purge system malfunction diagnosis device according to claim 1, wherein the execution module calculates the flow rate estimate on a basis of a pressure in the intake pipe and an opening degree of the purge valve.

5. The purge system malfunction diagnosis device according to claim 2, wherein the execution module calculates the flow rate estimate on a basis of a pressure in the intake pipe and an opening degree of the purge valve.

6. The purge system malfunction diagnosis device according to claim 1, wherein the execution module calculates the flow rate estimate on a basis of a pressure in the intake pipe and an opening degree of the purge valve.

7. The purge system malfunction diagnosis device according to claim 1, wherein the execution module calculates the flow rate estimate on a basis of a pressure in the intake pipe and an opening degree of the purge valve.

8. The purge system malfunction diagnosis device according to claim 3, wherein the execution module calculates the flow rate estimate on a basis of a pressure in the intake pipe and an opening degree of the purge valve.

9. The purge system malfunction diagnosis device according to claim 4, wherein the execution module calculates the flow rate estimate on a basis of the pressure in the purge system.

10. The purge system malfunction diagnosis device according to claim 5, wherein the execution module calculates the flow rate estimate on a basis of the pressure in the purge system.

11. The purge system malfunction diagnosis device according to claim 6, wherein the execution module calculates the flow rate estimate on a basis of the pressure in the purge system.

12. The purge system malfunction diagnosis device according to claim 7, wherein the execution module calculates the flow rate estimate on a basis of the pressure in the purge system.

13. The purge system malfunction diagnosis device according to claim 8, wherein the execution module calculates the flow rate estimate on a basis of the pressure in the purge system.

14. A purge system malfunction diagnosis device configured to diagnose a malfunction in a purge system mounted on a vehicle comprising an engine and configured to supply a purge gas including an evaporated fuel generated in a fuel tank to an intake pipe of the engine, the purge system comprising a canister configured to adsorb the evaporated fuel, a purge passage configured to cause the canister to communicate with the intake pipe of the engine, a purge valve capable of opening and closing the purge passage, an outside air passage configured to cause the canister to communicate with an outside air opening, an outside air valve capable of opening and closing the outside air passage, and a system pressure sensor configured to detect a pressure in the purge system, the purge system malfunction diagnosis device comprising circuitry configured to, in a state where the outside air passage is closed by the outside air valve, diagnose a malfunction in the purge system by:

calculating an integrated value of flow rate estimates of a purge gas that flows into the intake pipe from the purge passage, when the purge passage is opened by the purge valve, comparing the integrated value of the flow rate estimates with a reference integrated value;

comparing the pressure in the purge system as detected by the system pressure sensor with a pressure threshold when the integrated value of the flow rate estimates has reached the reference integrated value;

determining an occurrence of the malfunction when the pressure in the purge system as detected by the system pressure sensor is higher than the pressure threshold at the time the integrated value of the flow rate estimates has reached the reference integrated value; and reducing the integrated value of the flow rate estimates when the flow rate estimate is lower than a predetermined flow rate threshold.

* * * * *